US008712316B2

(12) United States Patent
Kimura

(10) Patent No.: US 8,712,316 B2
(45) Date of Patent: Apr. 29, 2014

(54) POST-PROCESSING DEVICE AND IMAGE FORMING SYSTEM

(75) Inventor: Masatoshi Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 120 days.

(21) Appl. No.: 13/440,325

(22) Filed: Apr. 5, 2012

(65) Prior Publication Data

US 2013/0108344 A1 May 2, 2013

(30) Foreign Application Priority Data

Oct. 27, 2011 (JP) ..... 2011-236433

(51) Int. Cl.
*G03G 15/00* (2006.01)

(52) U.S. Cl.
USPC ..... 399/410; 399/407

(58) Field of Classification Search
USPC ..... 399/410
See application file for complete search history.

(56) References Cited

U.S. PATENT DOCUMENTS 5,169,133 A * 12/1992 Iwata et al. ..... 270/58.11
5,765,824 A 6/1998 Kawano et al.
6,722,651 B2 * 4/2004 Fujisawa et al. ..... 271/220
6,983,885 B2 * 1/2006 Endo et al. ..... 235/449
7,520,505 B2 * 4/2009 Thomas et al. ..... 271/220
8,439,342 B2 * 5/2013 Okamoto et al. ..... 270/58.11
2002/0163119 A1 * 11/2002 Kawata ..... 271/207
2009/0250861 A1 10/2009 Kimura

FOREIGN PATENT DOCUMENTS

JP 3680404 B2 8/2005
JP 2009-249098 A 10/2009

* cited by examiner

*Primary Examiner* — Anthony Nguyen
(74) *Attorney, Agent, or Firm* — Sughrue Mion, PLLC

(57) ABSTRACT

A post-processing device includes: a casing having an opening; a processing mechanism performing a process on a recording medium; an outputting unit including a contacting member contacting the recording medium and a moving member moving between a contact position to contact the recording medium and a non-contact position not to contact the recording medium and coming close to the contacting member when moving to the contact position, the outputting unit outputting the recording medium via the opening when the moving member is in the contact position; and a covering member moving between a covering position to cover the opening and an un-covering position to uncover the opening to pass the recording medium. When the processing mechanism performs the process, the covering member moves to the covering position, and after the process is performed, the covering member moves to the un-covering position while the moving member moves to the contact position.

12 Claims, 11 Drawing Sheets

POST-PROCESSING DEVICE AND IMAGE FORMING SYSTEM

CROSS REFERENCE TO RELATED APPLICATIONS

This application is based on and claims priority under 35 USC §119 from Japanese Patent Application No. 2011-236433 filed Oct. 27, 2011.

BACKGROUND

1. Technical Field

The present invention relates to a post-processing device and an image forming system.

2. Related Art

Conventionally, there is known a technique for, after image forming processes are performed on recording media, aligning the recording media and performing a post-process thereon.

SUMMARY

According to an aspect of the present invention, there is provided a post-processing device including: a casing having an opening; a processing mechanism that is provided within the casing and performs a predetermined process on a recording medium; an outputting unit including a moving member and a contacting member contacting the recording medium, the moving member moving between a contact position to contact the recording medium and a non-contact position not to contact the recording medium and coming close to the contacting member when the moving member moves to the contact position, the outputting unit outputs the recording medium via the opening when the moving member is in the contact position; and a covering member that moves between a covering position to cover the opening and an un-covering position to uncover the opening to allow the recording medium to pass through the opening, wherein, when the processing mechanism performs the process on the recording medium, the covering member moves to the covering position, and after the process is performed by the processing mechanism, the covering member moves to the un-covering position while the moving member moves to the contact position.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described in detail with reference to the attached drawings.

<Image Forming System 1>

Figure 1:
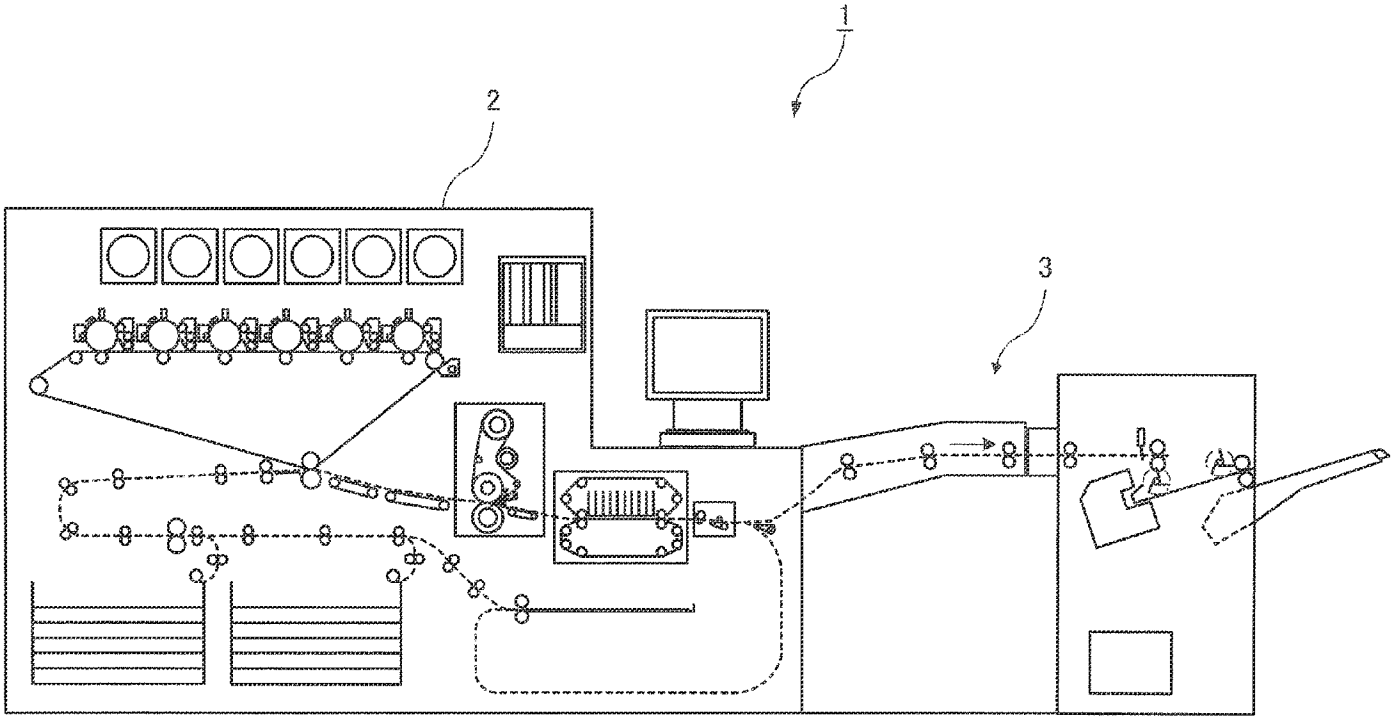
FIG. 1 illustrates an entire configuration of an image forming system to which an exemplary embodiment is applied.

FIG. 1 illustrates an entire configuration of an image forming system 1 to which the exemplary embodiment according to the present invention is applied. The image forming system 1 shown in FIG. 1 includes, for example, an image forming device 2 such as a printer or a copying machine that forms an image on a recording medium by an electrophotographic system, and a post-processing device 3 that performs a post process on a recording medium (for example, a sheet) on which an image is formed by the image forming device 2.

<Image Forming Device 2>

Figure 2:
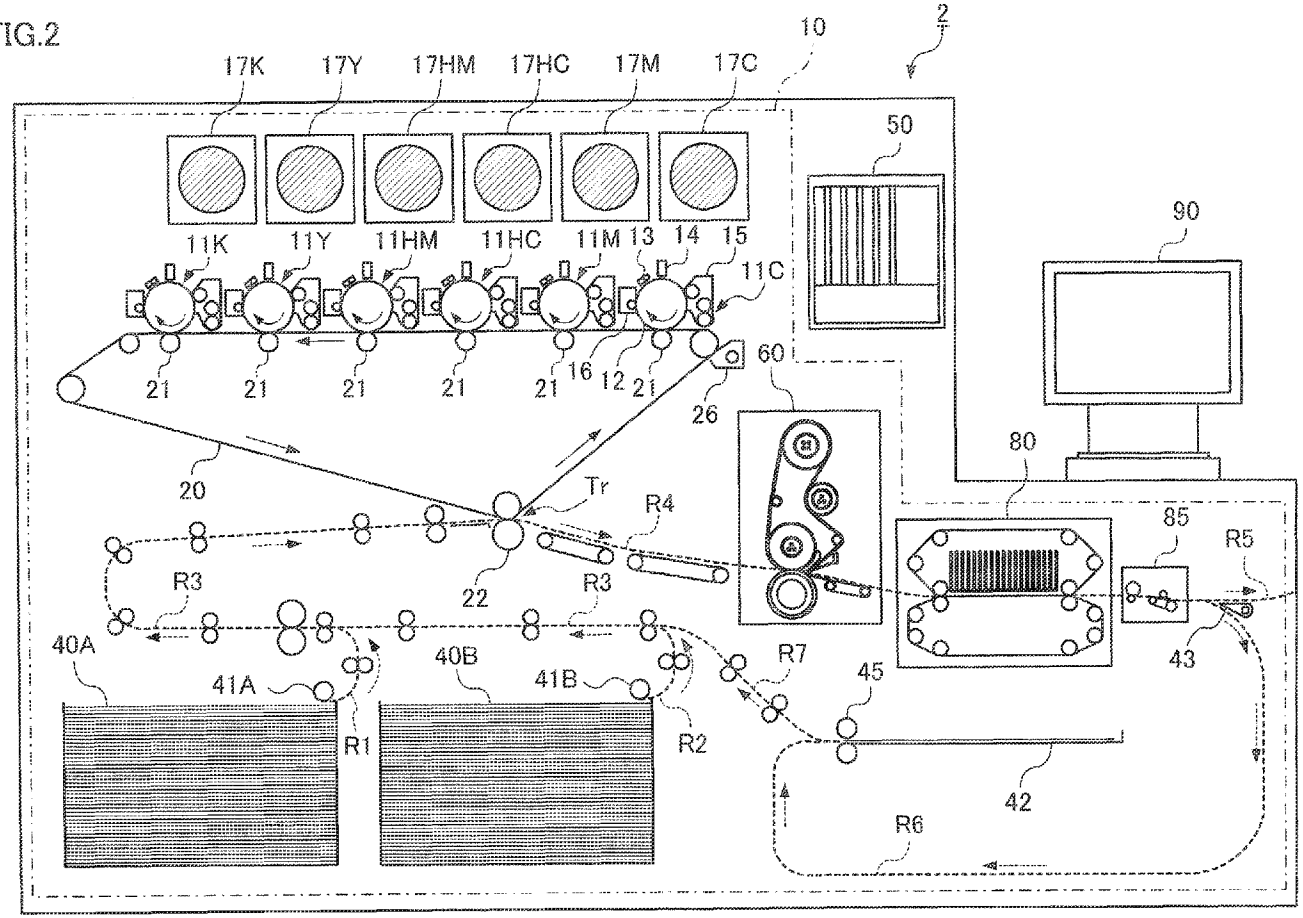
FIG. 2 illustrates an image forming device.

FIG. 2 illustrates the image forming device 2.

The image forming device 2 is a so-called "tandem-type" color printer, and includes: an image forming portion (image forming mechanism) 10 that forms an image based on image data; a main controller 50 that performs overall control of operations of the image forming device 2, communication with, for example, a personal computer (PC) or the like, image processing for image data, and the like; and a user interface (UI) portion 90 that receives an operation input from a user and displays various kinds of information to the user.

<Image Forming Portion 10>

The image forming portion 10 is a functional portion that forms an image by, for example, an electrophotographic system, and includes: six image forming units 11C, 11M, 11HC, 11HM, 11Y, 11K (hereinafter, referred to as "image forming units 11"); an intermediate transfer belt 20 onto which the toner images of respective colors formed on photoconductive drums 12 of the image forming units 11 are transferred; and primary transfer rolls 21 that transfer the toner images of respective colors formed on the photoconductive drums 12 of the image forming units 11 onto the intermediate transfer belt 20 (primary transfer).

The image forming portion 10 further includes: a secondary transfer roll 22 that collectively transfers the toner images of respective colors that have been transferred onto the intermediate transfer belt 20 in an superimposed manner onto a recording medium (secondary transfer); and a fixing unit 60 as an example of a fixing portion (fixing device) that fixes the toner images of respective colors having been subjected to the secondary transfer onto the recording medium.

In addition, the image forming portion 10 includes: a cooling unit 80 that cools the toner images of respective colors fixed onto the recording medium by the fixing unit 60 so that toner images of respective colors are more securely fixed onto the recording medium; and a curl correction unit 85 that corrects a curl in the recording medium.

It should be noted that an area where the secondary transfer roll 22 is placed and where the toner images of respective colors on the intermediate transfer belt 20 are transferred onto the recording medium through the secondary transfer is hereinafter referred to as "secondary transfer area Tr."

<Image Forming Unit 11>

As functional members, each image forming unit 11 includes, for example: the photoconductive drum 12 on which an electrostatic latent image is formed and then a toner image of each color is formed; a charging device 13 that charges the surface of the photoconductive drum 12 at a predetermined potential; an exposure device 14 that exposes, based on the image data, the photoconductive drum 12 charged by the charging device 13; a developing device 15 that develops the electrostatic latent image formed on the photoconductive drum 12 by toner of each color; and a cleaner 16 that cleans the surface of the photoconductive drum 12 after the transfer.

The developing device 15 of each image forming unit 11 is connected, through a toner supply path (not shown), to a corresponding one of toner containers 17C, 17M, 17HC, 17HM, 17Y, 17K (hereinafter, referred to as "toner containers 17") storing toner of respective colors. The toner containers 17 replenish the developing devices 15 with toner of respective colors using replenishment screws (not shown) provided in the toner supply paths.

Each of the image forming units 11 has almost the same configuration except for the color of toner contained in the developing devices 15. The image forming units 11 form toner images of cyan (C), magenta (M), highly saturated cyan (HC), highly saturated magenta (HM), yellow (Y), and black (K), respectively. Here, HC is cyan having a cyan hue and having a brighter color tone and a relatively higher saturation than C. HM is magenta having a magenta hue and having a brighter color tone and a relatively higher saturation than M.

<Recording Medium Transport System>

The image forming portion 10 includes, as a recording medium transport system: multiple (two in the exemplary embodiment) recording medium containers 40A and 40B that hold recording media; pick-up rolls 41A and 41B that pick up a recording medium held in the recording medium containers 40A and 40B, respectively, and transport the recording medium; a first transport path R1 for transporting the recording medium from the recording medium container 40A; and a second transport path R2 for transporting the recording medium from the recording medium container 40B. The image forming portion 10 further includes a third transport path R3 for transporting the recording medium from the recording medium container 40A or 40B toward the secondary transfer area Tr. Moreover, the image forming portion 10 includes: a fourth transport path R4 for transporting the recording medium onto which the toner images of the respective colors are transferred at the secondary transfer area Tr, so that the recording medium passes the fixing unit 60, the cooling unit 80, and the curl correction unit 85; and a fifth transport path R5 for transporting the recording medium outputted by the curl correction unit 85 from an output portion of the image forming device 2 toward the post-processing device 3.

Transport rolls and transfer belts are arranged along the first transport path R1 to the fifth transport path R5, sequentially transporting the recording media being fed.

<Duplex Transport System>

The image forming portion 10 includes, as a duplex transport system: an intermediate recording medium container 42 that temporarily holds the recording medium having a first surface onto which the toner images of the respective colors are fixed; a sixth transport path R6 for transporting the recording medium from the curl correction unit 85 toward the intermediate recording medium container 42; and a seventh transport path R7 for transporting the recording medium held in the intermediate recording medium container 42 toward the third transporting path R3 described above. The image forming portion 10 further includes: a switching mechanism 43 that is placed downstream of the curl correction unit 85 in a recording medium transport direction, and that selectively switches the transport direction of the recording medium between the fifth transport path R5 for transporting the recording medium toward the post-processing device 3 and the sixth transport path R6 for transporting the recording medium toward the intermediate recording medium container 42; and pick-up rolls 45 that pick up the recording medium held in the intermediate recording medium container 42 and transport the recording medium toward the seventh transport path R7.

<Image Forming Operations>

Next, with reference to FIG. 2, a description is given to basic image forming operations of the image forming device 2 according to the exemplary embodiment.

The image forming units 11 of the image forming portion 10 form toner images of colors of C, M, HC, HM, Y, and K, respectively, by an electrophotographic process using the above-described functional members. The primary transfer rolls 21 sequentially perform primary transfer of the toner images of the respective colors formed on the respective image forming units 11 onto the intermediate transfer belt 20 to form a composite toner image in which the toner images of the respective colors are superimposed on one another. Along with the movement of the intermediate transfer belt 20 (arrow direction), the composite toner image on the intermediate transfer belt 20 is transported to the secondary transfer area Tr where the secondary transfer roll 22 is placed.

Meanwhile, in the recording medium transport system, according to the timing at which the image forming units 11 start image formation, the pick-up roll 41A or 41B rotates and picks up a recording medium from the recording medium container 40A or 40B, whichever is designated by the UI portion 90, for example. The recording medium picked up by the pick-up roll 41A or 41B is transported along the first transport path R1 or the second transport path R2 and then by the third transport path R3, and reaches the secondary transfer area Tr.

In the secondary transfer area Tr, the composite toner image held on the intermediate transfer belt 20 is collectively subjected to secondary transfer to the recording medium by a transfer electric field formed by the secondary transfer roll 22.

Thereafter, the recording medium onto which the composite toner image is transferred is separated from the intermediate transfer belt 20 and is transported to the fixing unit 60 along the fourth transport path R4. The composite toner image on the recording medium transported to the fixing unit 60 is subjected to a fixing process by the fixing unit 60 and is thus fixed onto the recording medium. Then, the recording medium having the fixed image formed thereon is cooled by the cooling unit 80, and a curl of the recording medium is then corrected by the curl correction unit 85. After that, in a simplex printing mode, the recording medium having passed the curl correction unit 85 is led by the switching mechanism 43 to the fifth transport path R5 and is transported toward the post-processing device 3.

It should be noted that the cleaners 16 remove toner attached to the photoconductive drums 12 after the primary transfer (residual toner after primary transfer), and a belt cleaner 26 removes toner attached to the intermediate transfer belt 20 after the secondary transfer (residual toner after secondary transfer).

In a duplex printing mode, on the other hand, the recording medium having the first surface onto which the image is fixed by the above-described process passes the curl correction unit 85 and then is led by the switching mechanism 43 to the sixth transport path R6 to be transported to the intermediate recording medium container 42. Then, according to the timing at which the image forming units 11 start image formation on a second surface of the recording medium, the pick-up rolls 45 rotate and pick up the recording medium from the intermediate recording medium container 42. The recording medium picked up by the pick-up rolls 45 is transported along the seventh transport path R7 and the third transport path R3, and reaches the secondary transfer area Tr.

In the secondary transfer area Tr, as in the case of the first surface, the composite toner image for the second surface held on the intermediate transfer belt 20 is collectively subjected to secondary transfer onto the recording medium by a transfer electric field formed by the secondary transfer roll 22.

Then, as in the case of the first surface, the recording medium having the toner image transferred onto both surfaces undergoes fixing at the fixing unit 60, is cooled by the cooling unit 80, and a curl of the recording medium is corrected by the curl correction unit 85. After that, the recording medium having passed the curl correction unit 85 is led by the switching mechanism 43 to the fifth transport path R5 and is transported toward the post-processing device 3.

In a manner described above, the cycle of the image formation process of the image forming apparatus 1 is repeated in cycles for the number of prints to be produced.

<Post-Processing Device 3>

Figure 3:
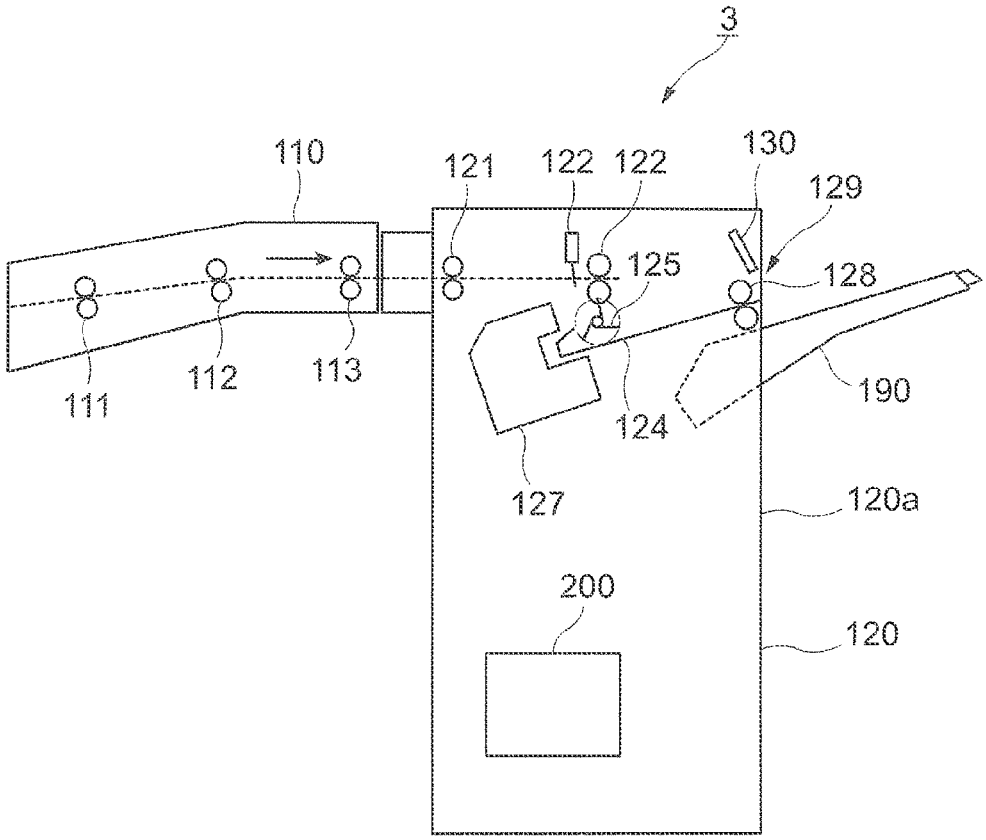
FIG. 3 illustrates a post-processing device to which the exemplary embodiment is applied.

FIG. 3 illustrates the post-processing device 3 to which the exemplary embodiment is applied.

The post-processing device 3 shown in FIG. 3 includes a transport portion 110 that transports the recording medium outputted from the image forming device 2 to the further downstream side, and a post-processing portion 120 including, for example, a compile stacking portion 124 that collects and bundles staples for a binding process or the recording media. Further, the post-processing device 3 includes a stacker 190 for stacking the recording media so that a user can easily pick up the recording media. Moreover, the post-processing device 3 includes a controller 200 that controls entire post-processing device 3, which is, for example, provided in the post-processing portion 120.

As shown in FIG. 3, the transport portion 110 of the post-processing device 3 includes: an entrance roll 111 that is a pair of rolls to receive the recording medium having been subjected to printing and outputted from the image forming device 2 (refer to FIG. 1); a first transport roll 112, which is a pair of rolls to transport the recording medium to the downstream side; and a second transport roll 113, which is also a pair of rolls to transport the recording medium toward the post-processing portion 120.

The post-processing portion 120 of the post-processing device 3 includes each following member within a casing structure (casing) 120*a*: a receiving roll 121, which is a pair of rolls to receive the recording medium from the transport portion 110; and an exit sensor 122 provided on a downstream side of the receiving roll 121 to detect the recording medium. The post-processing portion 120 also includes the compile stacking portion 124 that collects plural recording media sequentially transported and contains thereof, and an exit roll 123, which is a pair of rolls to allow the recording medium to be outputted toward the compile stacking portion 124.

Further, the post-processing portion 120 includes paddles 125 that rotate so as to push trailing edges of the recording media toward an end guide 124*b* (described later) of the compile stacking portion 124, and a stapler 127 for binding end portions of a stack of recording media. Moreover, the post-processing portion 120 includes an eject roll 128 that transports a stack of recording media collected at the compile stacking portion 124 toward the stacker 190.

Here, in the casing structure 120*a* of the post-processing portion 120, an opening portion 129, through which the stack of recording media passes when the stack is outputted toward the stacker 190 by the eject roll 128, is formed. The post-processing portion 120 includes a covering member 130 to cover the opening portion 129.

Further, the post-processing portion 120 includes a driving mechanism 171 (refer to FIG. 5, which will be described later) that provides a driving force for changing arrangement of the eject roll 128 and the covering member 130 in response to the binding process performed by the stapler 127.

Figure 4:
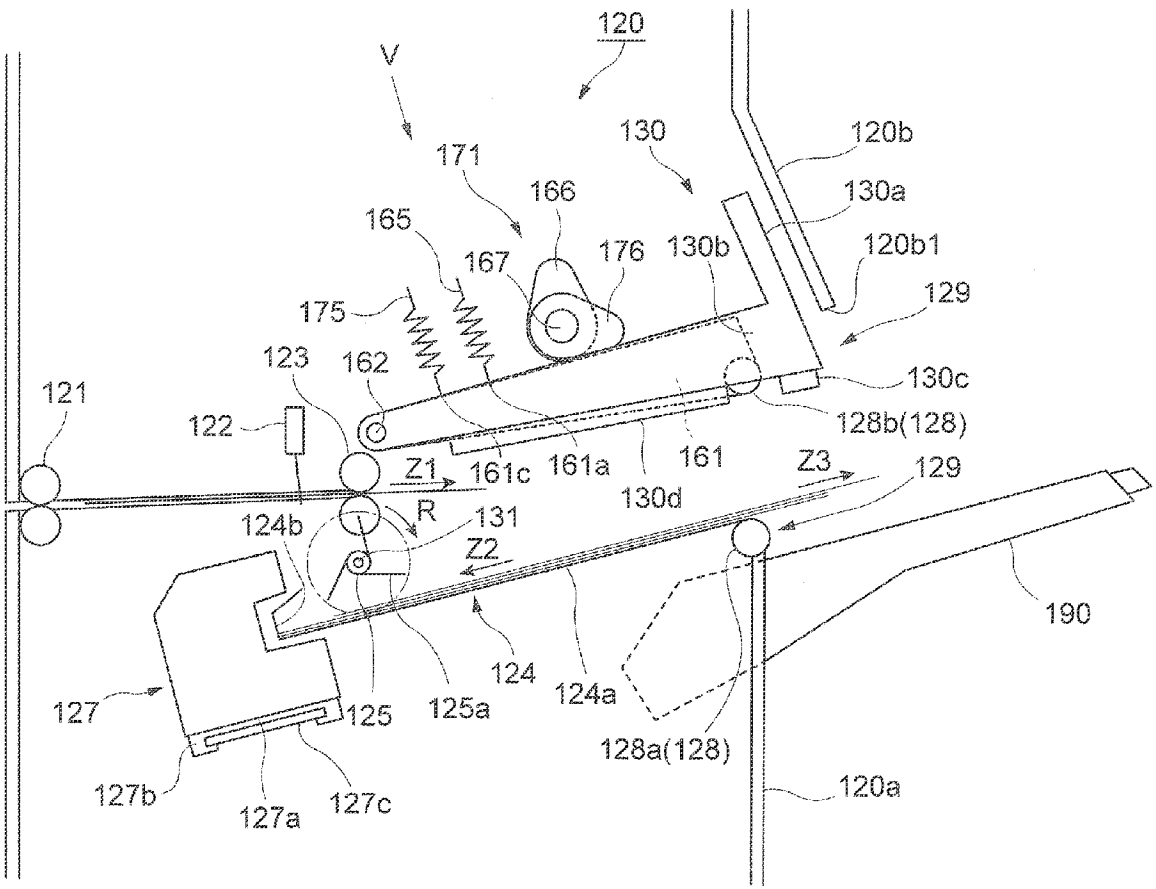
FIG. 4 illustrates in detail a configuration of a post-processing portion to which the exemplary embodiment is applied.
Figure 5:
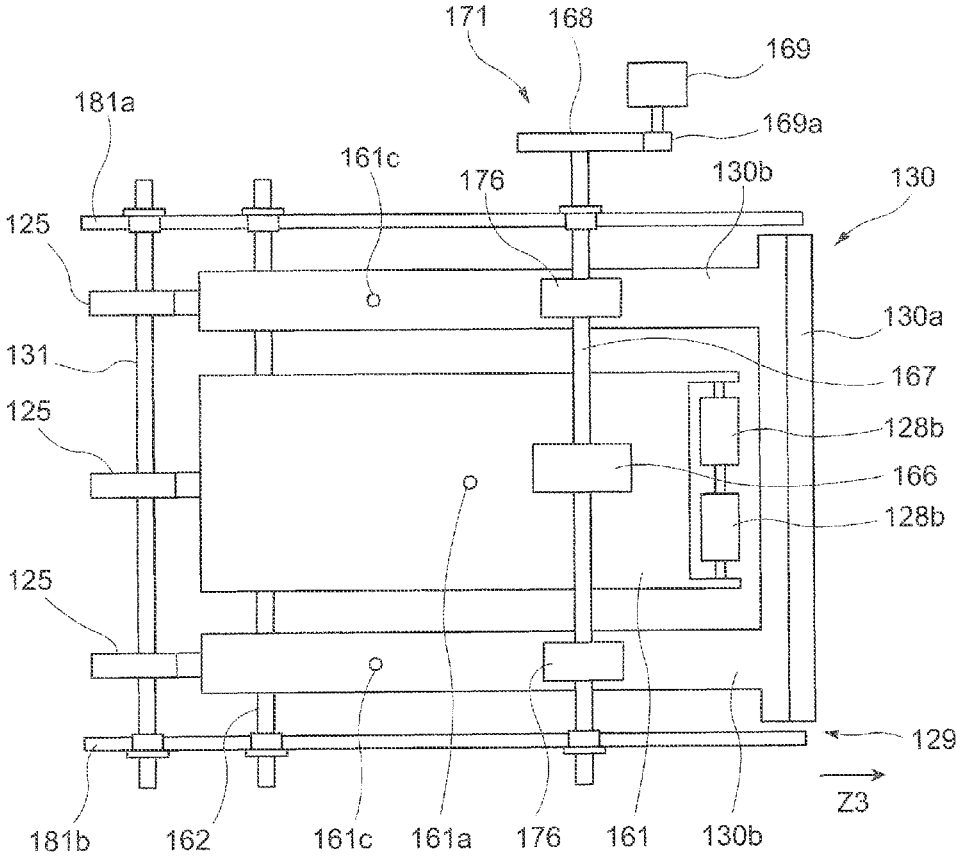
FIG. 5 illustrates the configuration of the post-processing portion in a direction intersecting a recording medium transporting direction.

FIG. 4 illustrates a configuration of the post-processing portion 120 to which the exemplary embodiment is applied in detail. FIG. 5 illustrates the configuration of the post-processing portion 120 in a direction intersecting a recording medium transporting direction. It should be noted that FIG. 5 shows the post-processing portion 120 as viewed from the direction V in FIG. 4.

First, the compile stacking portion 124 includes a recording medium stacking base 124*a* that receives the recording medium from the exit roll 123 and stacks thereof, and an end guide 124*b* formed in a direction intersecting a recording medium stacking surface of the recording medium stacking base 124*a*. The end guide 124*b* is a reference surface, which is referred to for aligning end faces of the recording media when the recording media outputted from the exit roll 123 are aligned, and a stack of recording media is generated by striking the end faces of the recording media to the end guide 124*b*.

Each of the paddles 125 has, as shown in FIG. 4, three flexible recording medium contact portions 125*a*, and thereby contacts a top surface of a recording medium (or an uppermost surface of a stack of recording media) to transport the recording medium toward the end guide 124*b*. Each paddle 125 includes a paddle support shaft 131 above the compile stacking portion 124 on the end guide 124*b* side thereof, which is rotatably supported by device frames 181*a* and 181*b* of the post-processing device 3 (refer to FIG. 5). Plural (three in the exemplary embodiment) paddles 125 are secured to and supported by the paddle support shaft 131 with some spacing in a direction orthogonal to (intersecting) the recording medium transport direction. The paddle support shaft 131 is rotationally driven by a not-shown motor arranged in the back of the device (corresponding to a backward side of the page in FIG. 4 and upper side of the page in FIG. 5). Then, as the paddle support shaft 131 rotates, the paddles 125 also rotate in the direction R in FIG. 4 to press the recording media having been transported toward the direction Z1 in FIG. 4 into the direction Z2 on the recording medium stacking base 124*a*.

Further, though not shown in the figure, the post-processing portion 120 includes a tamper for aligning both ends of the recording media (both ends in a direction orthogonal to the recording medium transport direction) in the direction orthogonal to (intersecting) the recording medium transport direction of the compile stacking portion 124.

Next, the stapler 127 will be described.

The stapler 127 includes: a stapler head 127*a* that performs a binding process using staples on a stack of recording media; a base 127*b* that supports the stapler head 127*a*; and a rail 127*c* that is provided on the base 127*b* and forms a route on which the stapler head 127*a* moves. The rail 127*c* is formed along an end portion of the recording medium stacking base 124*a* and the stapler head 127*a* moves on the rail 127*c* to perform the binding process. The stapler 127 further includes: a stapler moving motor (not shown), which is a stepping motor for moving the stapler head 127*a*; a stapler moving home sensor (not shown) that detects a home position of the stapler head 127*a*; and a stapler center position sensor (not shown) that detects a center position of the stapler head 127*a*.

In the case of performing single-point binding on a stack of recording media on the compile stacking portion 124, the stapler head 127*a* stays at a first home position, which is detected by the stapler moving home sensor (not shown), to perform the binding process in order.

On the other hand, in the case of performing two-point binding on a stack of recording media, first, the stapler head 127*a* is on standby at a second home position detected by the stapler center position sensor (not shown). Then, after one set of recording media is placed on the compile stacking portion 124, the stapler moving motor (not shown) is driven to move the stapler head 127*a* to a stapling position, and thereby the binding process is performed at two points.

It should be noted that, the stapler 127 has been described as an example of a processing mechanism; however, for example, a binding processing device that performs a binding process on recording media without using staples, a puncher for punching the recording media, a folding line maker that makes folding lines on the recording media or the like may be employed as a recording medium processing mechanism.

<Eject Roll 128>

Next, the eject roll 128 will be described.

The eject roll 128 as an example of an outputting unit includes a driving eject roll 128*a* and following eject rolls 128*b* as shown in FIG. 4. The driving eject roll 128*a* and the following eject rolls 128*b* are provided to be mutually separable.

The driving eject roll 128*a* as an example of a contacting member is secured to and supported by a rotational shaft (not shown) that is rotatably supported by the device frames 181*a* and 181*b* (refer to FIG. 5), and is rotatably driven by a not-shown eject motor. By the rotation of the eject motor, the driving eject roll 128*a* is rotated and the following eject rolls 128*b* are also rotated to follow, and thereby the recording media stacked on the compile stacking portion 124 are outputted (refer to arrow Z3 in FIG. 4).

The following eject rolls 128*b* as an example of a moving member are supported by a following eject roll support member 161. Though details will be described later, along with swinging (rotation) of the following eject roll support member 161, the following eject rolls 128*b* reciprocate between a contact position to contact the recording media stacked on the recording medium stacking base 124*a* of the compile stacking portion 124 and a retract position (non-contact position) to retract from the recording media stacked on the recording medium stacking base 124*a* of the compile stacking portion 124.

In the example shown in FIG. 5, the following eject rolls 128*b* are rotatably supported at an end portion of the following eject roll support member 161, the end portion facing the stacker 190 (refer to FIG. 4). Further, the following eject roll support member 161 is fitted over a support shaft 162 at the other end portion with a loose fit. It should be noted that, as shown in FIG. 5, the support shaft 162 is secured to and supported by the device frames 181*a* and 181*b*.

Moreover, in the following eject roll support member 161, a hole 161*a* is formed between a position of fitting over the support shaft 162 and a position of supporting the following eject roll 128*b*. One end of a coil spring 165 is attached to the hole 161*a*. The other end of the coil spring 165 is attached to a device frame (not shown). Consequently, the following eject roll support member 161 is provided with a force for moving the following eject roll 128*b* in a direction to separate from the compile stacking portion 124 (direction from the contact position toward the retract position) by the coil spring 165. It should be noted that the following eject roll support member 161 is arranged at a position to contact an eject roll cam 166, which will be described later, and thereby the following eject roll 128 receives a force to move in a direction for approaching the compile stacking portion 124 (direction from the retract position toward the contact position).

<Opening Portion 129>

Next, the opening portion 129 will be described.

First, as described above, the opening portion 129 is an opening formed in the casing structure 120*a*, and is a region through which a stack of recording media outputted by the eject roll 128 toward the stacker 190 passes.

Though a description has been omitted above, as shown in FIG. 4, the post-processing portion 120 includes an inclined portion 120*b* that is a plate-like member constituting a part of the casing structure 120*a*, and is arranged above the opening portion 129 to be inclined along with the movement of a shutter member 130*a*, which will be described later. The inclined portion 120*b* is arranged to cover the shutter member 130*a* (described later) of the covering member 130 arranged at a covering position. It should be noted that, in the example shown in the figure, an end portion 120*b*1 (lower end portion in FIG. 4) of the inclined portion 120*b* facing the stacker 190 is arranged to be outwardly of the post-processing portion 120 compared to the other end portion of the inclined portion 120*b*.

As shown in FIG. 4, the opening portion 129 in a specific example shown in the figure is formed over the range spreading from the end portion 120*b*1 of the inclined portion 120*b* facing the stacker 190 to the driving eject roll 128*a* arranged along the casing structure 120*a*. Further, as shown in FIG. 5, the opening portion 129 is formed over the range between the device frames 181*a* and 181*b*.

<Covering Member 130>

Next, the covering member 130 will be described.

The covering member 130 as an example of an covering member includes: a shutter member (shutter) 130*a* that covers the opening portion 129 formed in the casing structure 120*a*; and a support member 130*b* that reciprocatingly (rotatably) supports the shutter member 130*a*. The covering member 130 also includes: a sound absorbing member 130*c*, as an example of a sound absorbent, that is provided at a portion of the shutter member 130*a*, the portion facing the compile stacking portion 124; and a recording medium guide member (recording medium transport path) 130*d* that is provided at a portion of the support member 130*b*, the portion facing the compile stacking portion 124, and guides the recording medium having been transported in the direction Z1 in FIG. 4 to the compile stacking portion 124.

Though details will be described later, the covering member 130 reciprocates between the covering position where the shutter member 130*a* covers the opening portion 129 and an un-covering position where the shutter member 130*a* retracts from the opening portion 129 and opens the opening portion 129 so that a stack of recording media can pass through the opening portion 129.

The shutter member 130*a* is a plate-like member and is formed with a dimension able to cover the opening portion 129. Further, as shown in FIG. 4, the shutter member 130*a* is provided on the downstream side of the following eject rolls 128*b* in the direction Z3. In addition, when the covering member 130 is at the covering position, the shutter member 130*a* is in the state of covering the following eject rolls 128*b* as well as the opening portion 129.

As shown in FIG. 5, the support member 130*b* supports the shutter member 130*a* at an end portion thereof facing the stacker 190. Here, there are two support members 130*b* formed in the upper and lower directions in the figure with the following eject roll 128*b* and the following eject roll support member 161 interposed therebetween.

Further, each of the support members 130*b* is fitted over the support shaft 162 at an end portion opposite to the end portion facing the stacker 190. Further, in the support member 130*b*, a hole 161*c* is formed between the position of fitting over the support shaft 162 and the position of supporting the shutter member 130*a*. One end of a coil spring 175 is attached to the hole 161*c*. The other end of the coil spring 175 is attached to a device frame (not shown). Consequently, the support members 130*b* are provided with a force for moving the shutter member 130*a* in a direction to separate from the compile stacking portion 124 (direction from the covering position toward the un-covering position) by the coil spring 175. It should be noted that each of the support members 130*b* is arranged at a position to contact an covering member cam 176, which will be described later, and thereby the support member 130*b* receives a force to move in a direction for approaching the compile stacking portion 124 (direction from the un-covering position toward the covering position).

The sound absorbing member 130*c* is formed of, for example, a sponge-like member such as urethane. The sound absorbing member 130*c* is pressed against the recording media stacked on the compile stacking portion 124 along with the arrangement of the shutter member 130*a* at the covering position. To be described further, a space between the recording media stacked in the compile stacking portion 124 and the shutter member 130*a* arranged at the covering position is filled with the sound absorbing member 130*c*. The sound absorbing member 130*c* suppresses leakage of a noise to the outside from between the recording media stacked on the compile stacking portion 124 and the shutter member 130*a*, the noise being generated within the post-processing portion 120 (refer to FIG. 3).

Further, the sound absorbing member 130*c* is elastically deformed by being pressed by the recording media stacked on the compile stacking portion 124. This makes it unnecessary to change the above-described covering position according to the thickness of a stack of recording media even in the case where the thickness of the stack of recording media stacked on the compile stacking portion 124 is varied.

It should be noted that, in the specific example shown in the figure, the sound absorbing member 130*c* of the covering member 130 at the covering position contacts a part of the recording media that lies out of the recording medium stacking base 124*a* of the recording medium stacking portion 124, namely, a part of the recording media not supported by the recording medium stacking base 124*a*.

The recording medium guide member 130*d* is formed by, for example, a plate-like member. As shown in FIG. 4, when the covering member 130 is arranged at the un-covering position, the recording medium guide member 130*d* is arranged, to guide the recording medium having been transported from the exit roll 123 in the direction Z1 to the compile stacking portion 124.

As described above, the covering member 130 and the following eject roll support member 161 are provided to rotationally move around the support shaft 162, which is a common rotational shaft. Here, as shown in FIG. 5, the covering member 130 and the following eject roll support member 161 are arranged with spacing not to interfere with each other. In addition, the shutter member 130*a* and the following eject rolls 128*b* are also arranged with spacing not to interfere with each other.

<Driving Mechanism 171>

Next, the driving mechanism 171 will be described.

As shown in FIG. 5, the driving mechanism 171 as an example of a driving unit includes the eject roll cam (first pressing portion) 166 that is provided in contact with the following eject roll support member 161 to press the following eject roll support member 161. The driving mechanism 171 further includes the covering member cam (second pressing portion) 176 that is provided in contact with the support member 130*b* to press the support member 130*b*. Here, there are two covering member cams 176 formed in the upper and lower directions in the figure with the eject roll cam 166 interposed therebetween.

Further, the driving mechanism 171 includes: a cam shaft 167 that is a rotational shaft for supporting the eject roll cam 166 and the covering member cams 176; a gear 168 provided at one end portion of the cam shaft 167; a pinion 169*a* that engages the gear 168; and a drive motor 169 that applies a rotational force to the pinion 169*a*.

As shown in FIG. 4, the eject roll cam 166 rotates to press the following eject roll support member 161, thereby providing a moving force by which the following eject roll 128*b* moves from the retract position toward the contact position (moving in a clockwise direction in FIG. 4).

The covering member cams 176 rotate to press the support members 130*b*, and thereby provide a moving force by which the shutter member 130*a* moves from the un-covering position toward the covering position (moving in the clockwise direction in FIG. 4).

It should be noted that the eject roll cam 166 and the covering member cams 176 are provided to the cam shaft 167 with mutually different phases. Accordingly, though details will be described later, there is a difference between the time when the eject roll cam 166 moves the following eject roll support member 161 and the time when the covering member cams 176 move the support members 130*b*.

As shown in FIG. 5, the cam shaft 167 is rotatably supported by the device frames 181*a* and 181*b*. As described above, the eject roll cam 166 and the covering member cams 176 are provided to the cam shaft 167. The cam shaft 167 is rotated upon receiving a driving force from the drive motor 169. Consequently, in the exemplary embodiment, the following eject rolls 128*b* and the covering member 130 change each position thereof while receiving a driving force from the common driving source. To be further described, the exemplary embodiment has a configuration in which the following eject rolls 128*b* and the covering member 130 operate in conjunction with each other.

The drive motor 169 is a DC motor in which a voltage (current) to be applied is proportional to a generated torque; therefore, the higher the voltage applied to the drive motor 169, the higher the rotational speed becomes, while the lower the applied voltage, the lower the rotational speed becomes. When the rotational speed of the drive motor 169 becomes higher, the rotational speed of each of the eject roll cam 166 and the covering member cams 176 becomes higher, and when the rotational speed of the drive motor 169 becomes lower, the rotational speed of each of the eject roll cam 166 and the covering member cams 176 becomes lower.

<Arrangement of Following Eject Roll 128*b* and Covering Member 130>

Here, with reference to FIGS. 4, 5 and 6A-6C, a description will be given to arrangement of the following eject roll 128*b* and the covering member 130, which is changed by the rotation of the cam shaft 167. It should be noted that FIGS. 6A to 6C illustrate the arrangement of the following eject roll 128*b* and the covering member 130.

First, along with one revolution (revolution in a clockwise direction in FIG. 4) of the cam shaft 167, the cam shaft 167 is placed at a standby angle, a closing angle and an outputting angle in order. Hereinafter, a description will be given to the arrangement of the following eject rolls 128*b* and the covering member 130 when the cam shaft 167 is at the standby angle, the closing angle and the outputting angle.

Figure 6A:
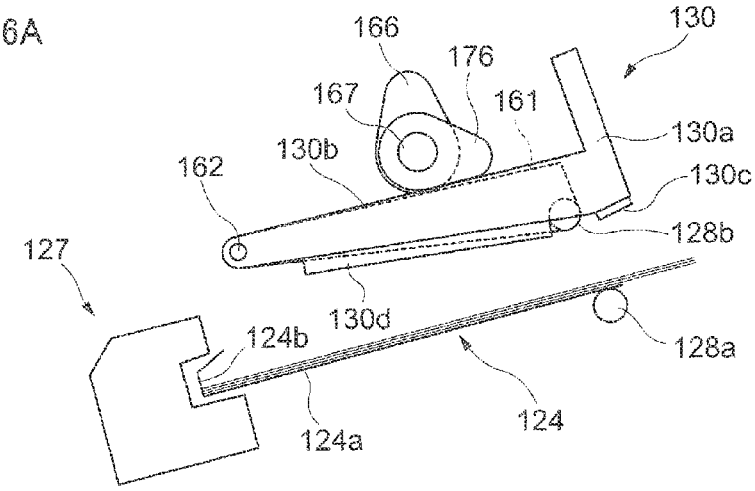
FIGS. 6A to 6C illustrate arrangement of a following eject roll and a covering member.
Figure 6B:
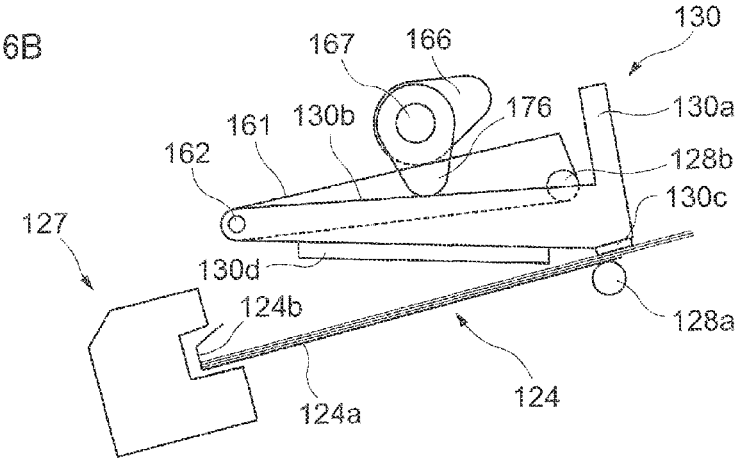
Figure 6C:
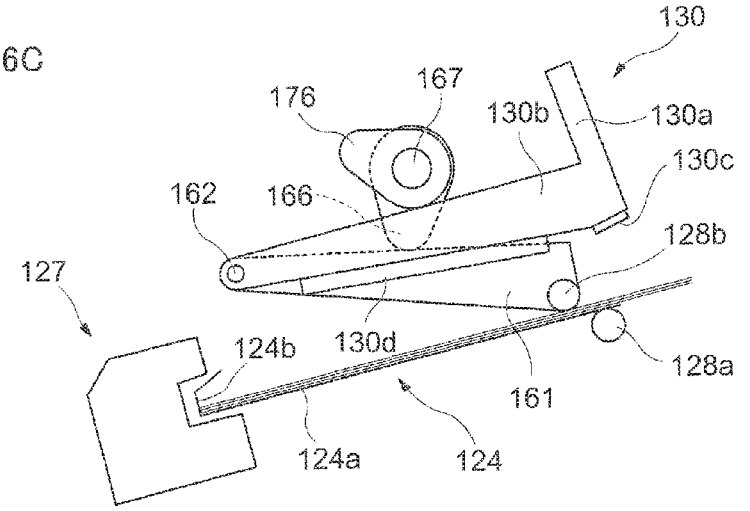

In FIG. 6A, the cam shaft 167 is arranged at the standby angle.

In the state where the cam shaft 167 is arranged at the standby angle, a portion of the eject roll cam 166 nearest to the rotational center thereof contacts the following eject roll support member 161, and a portion of each covering member cam 176 nearest to the rotational center thereof contacts the support member 130*b*.

As shown in FIG. 6A, when the cam shaft 167 is at the standby angle, the following eject rolls 128*b* are arranged at the retract position where the following eject rolls 128*b* are retracted from the recording media stacked on the recording medium stacking base 124*a* of the compile stacking portion 124. At the retract position, the following eject rolls 128*b* do not hinder the transport of the recording media by the exit roll 123 (refer to FIG. 4).

Further, when the cam shaft 167 is at the standby angle, the covering member 130 is arranged at the un-covering position where the shutter member 130*a* of the covering member 130 is retracted from the opening portion 129 (refer to FIG. 5) to open the opening portion 129 so that a stack of recording media is able to pass through the opening portion 129. At the un-covering position, the covering member 130 does not hinder the transport of the recording media by the exit roll 123. It should be noted that, in the exemplary embodiment, the recording medium guide member 130*d* provided in the covering member 130 is arranged along the direction from the exit roll 123 toward the compile stacking portion 124 when the cam shaft 167 is at the standby angle.

In FIG. 6B, the cam shaft 167 is arranged at the closing angle.

In the state where the cam shaft 167 is arranged at the closing angle, a portion of the eject roll cam 166 positioned at the middle of the portion nearest to the rotational center thereof and a portion farthest from the rotational center thereof contacts the following eject roll support member 161, and a portion of each covering member cam 176 farthest from the rotational center thereof contacts the support member 130*b*.

As shown in FIG. 6B, when the cam shaft 167 is at the closing angle, the following eject rolls 128*b* are at a position separated from the recording media stacked on the recording medium stacking base 124*a* of the compile stacking portion 124, and is also at a nearby position that is closer to the recording media than the retract position. For example, the distance between the following eject rolls 128*b* and the recording media is set to 5 mm or less.

Further, when the cam shaft 167 is at the closing angle, the covering member 130 is arranged at the covering position where the shutter member 130*a* of the covering member 130 covers the opening portion 129. More specifically, at the covering position, the sound absorbing member 130*c* provided in the shutter member 130*a* contacts the recording media stacked on the recording medium stacking base 124*a* of the compile stacking portion 124.

In FIG. 6C, the cam shaft 167 is arranged at the outputting angle.

In the state where the cam shaft 167 is arranged at the outputting angle, a portion of the eject roll cam 166 farthest from the rotational center thereof contacts the following eject roll support member 161, and a portion of each covering member cam 176 nearest to the rotational center thereof contacts the support member 130*b*.

As shown in FIG. 6C, when the cam shaft 167 is at the outputting angle, the following eject rolls 128*b* are arranged at the contact position where the following eject rolls 128*b* contact the recording media stacked on the recording medium stacking base 124*a* of the compile stacking portion 124. In the state shown in FIG. 6C, the recording media are held by the following eject rolls 128*b* and the driving eject roll 128*a* with a predetermined pressing force (nip pressure). It should be noted that, if the driving eject roll 128*a* rotates in this state, the following eject rolls 128*b* also rotate pursuant thereto, and thereby the recording media stacked on the recording medium stacking base 124*a* are collectively outputted toward the stacker 190 (refer to FIG. 4).

Moreover, when the cam shaft 167 is at the outputting angle, the covering member 130 is arranged at the un-covering position where the shutter member 130*a* of the covering member 130 opens the opening portion 129.

<Un-Covering Position and Covering Position of the Covering Member 130>

Figure 7A:
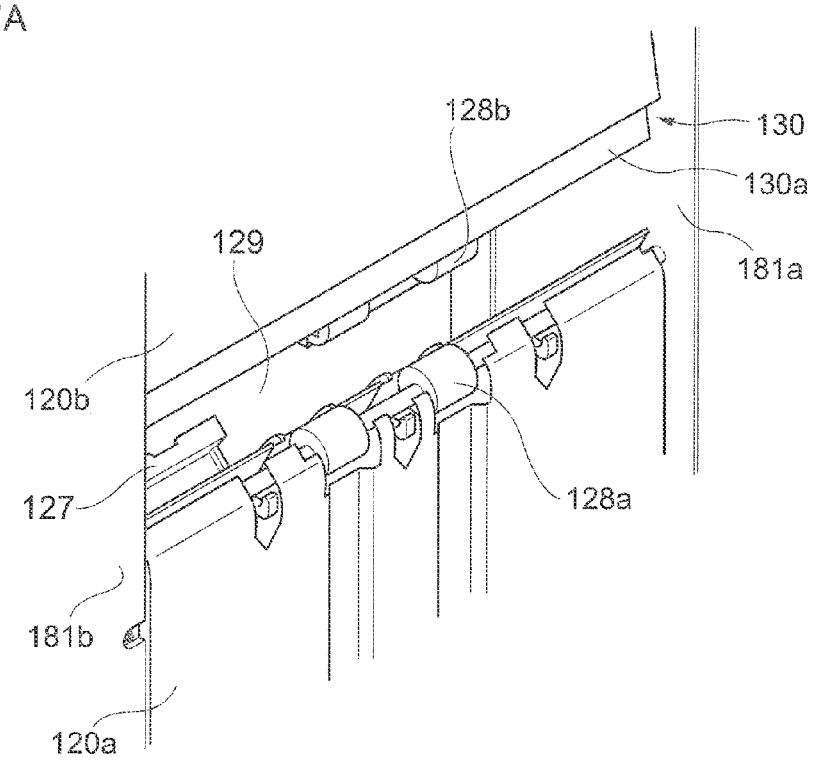
FIGS. 7A and 7B illustrate an un-covering position and a covering position of the covering member.
Figure 7B:
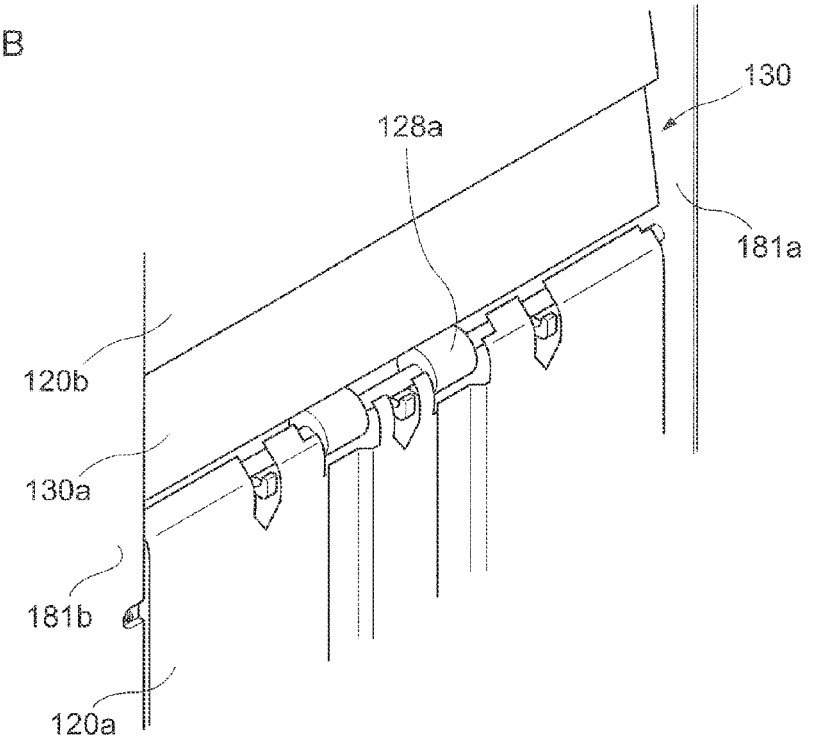

Here, with reference to FIGS. 7A and 7B, a description will be given to the un-covering position and the covering position of the covering member 130. FIGS. 7A and 7B illustrate the un-covering position and the covering position of the covering member 130.

FIG. 7A shows the covering member 130 at the un-covering position. As shown in the figure, the shutter member 130*a* of the covering member 130 at the un-covering position is in the state of opening the opening portion 129, which is a state where a stack of recording media is able to pass through the opening portion 129. It should be noted that, in the specific example shown in the figure, the shutter member 130*a* of the covering member 130 at the un-covering position does not hinder the output of the stack of recording media and is close to the compile stacking portion 124. This makes it possible to reduce the time required to move the shutter member 130*a* from the un-covering position to the covering position.

FIG. 7B shows the covering member 130 at the covering position. As shown in the figure, the shutter member 130*a* of the covering member 130 at the covering position is in the state of covering and closing the opening portion 129. By covering the opening portion 129 with the shutter member 130*a* in this manner, leakage of the noise generated within the post-processing portion 120 from the opening portion 129 to the outside of the post-processing portion 120 is suppressed.

<Controller 200>

Next, the controller 200 will be described.

Figure 8:
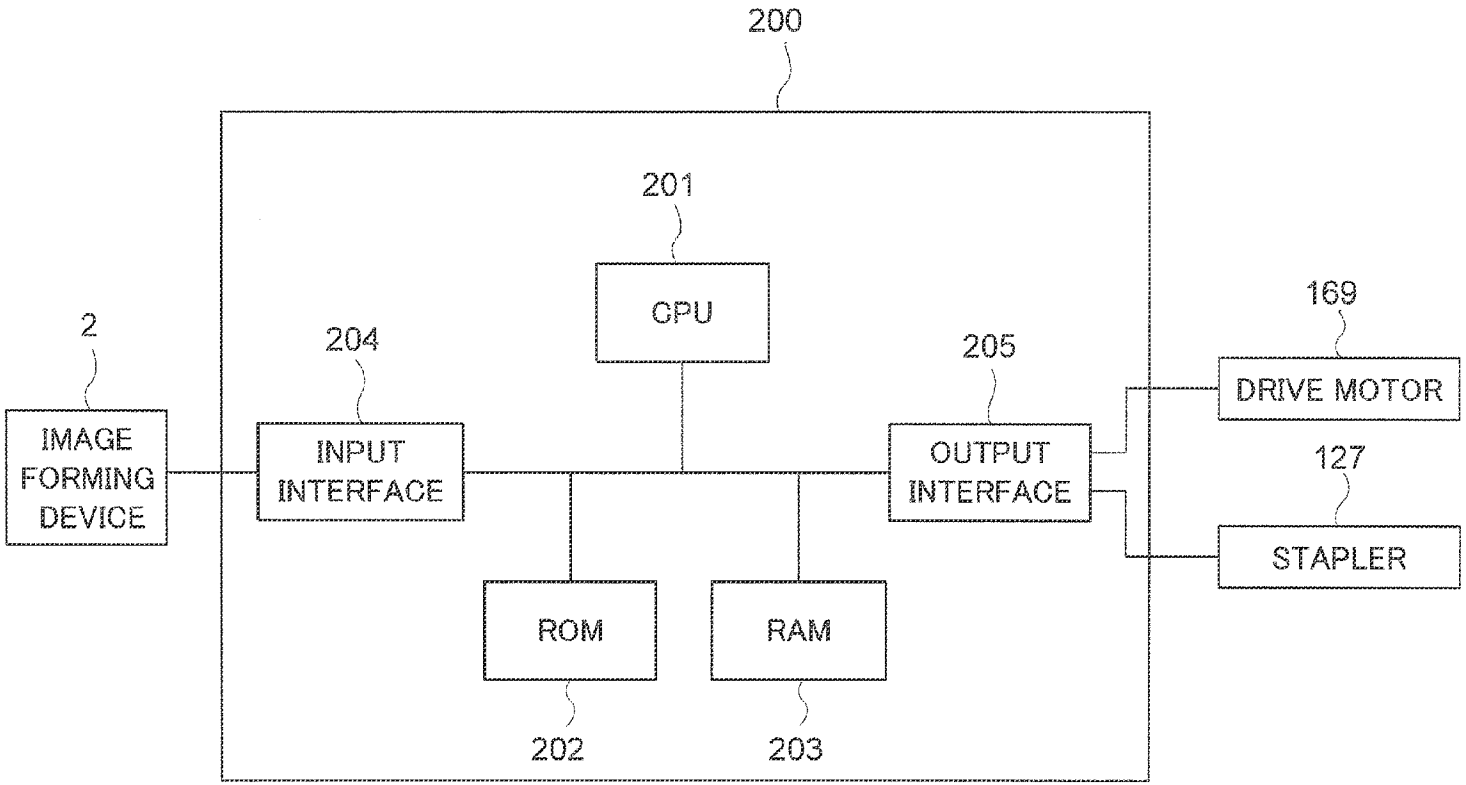
FIG. 8 is a block diagram of a controller.

FIG. 8 is a block diagram illustrating the controller 200.

The controller 200 includes, as shown in FIG. 8: a CPU 201; a ROM 202; a RAM 203; an input interface 204; and an output interface 205. In the ROM 202, for example, a binding processing program, a recording medium transporting program, an outputting program and so forth are stored in advance. The controller 200 captures signals from the controlling device, which is provided to the image forming device 2 (refer to FIG. 1), by the CPU 201 via the input interface 204. Then the CPU 201 performs a predetermined processing program to transmit a control signal to a controlled object via the output interface 205, and thereby controlling operations of, for example, the above-described stapler 127, drive motor 169, eject motor (not shown) and the like.

Next, control of the drive motor 169 and the stapler 127 performed by the controller 200 will be specifically described.

Figure 9:
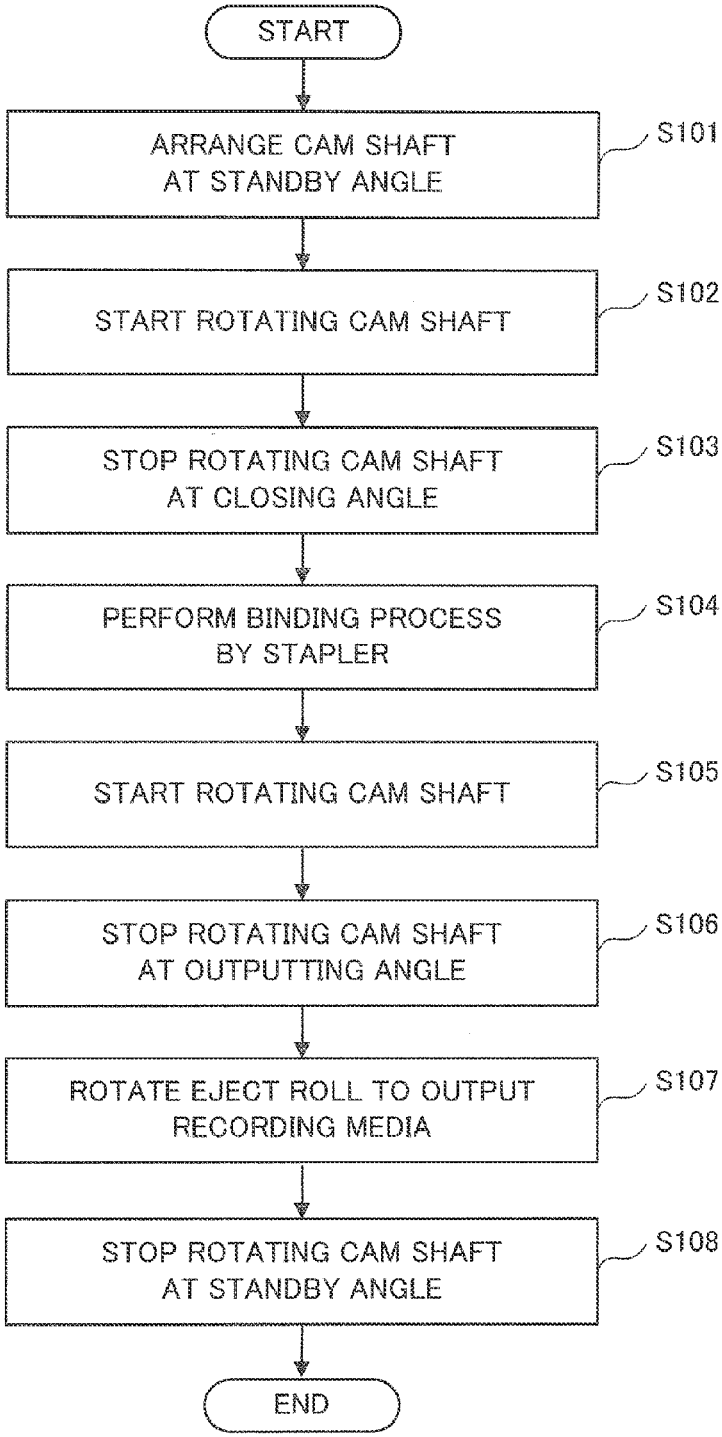
FIG. 9 is a flow chart illustrating procedures for controlling a drive motor and a stapler by the controller.

FIG. 9 is a flowchart illustrating procedures in the control of the drive motor 169 and the stapler 127 by the controller 200. Further, FIGS. 10A to 10E illustrate operations of each member in the post-processing device 3, the member being moved by the operation of the drive motor 169.

Figure 10A:
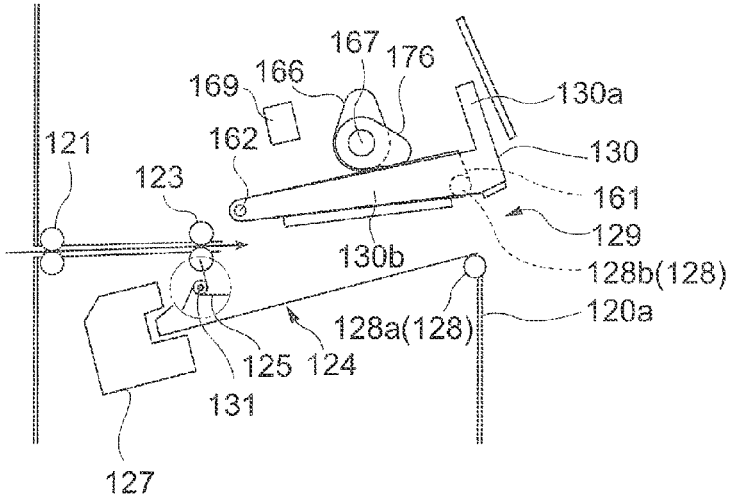
FIG. 10A to 10E illustrate operation of each member in the post-processing device, each member being moved by operation of the drive motor.

As shown in FIG. 10A, the controller 200 makes the cam shaft 167 rotate and stop at the standby angle (step 101). At this time, the following eject rolls 128*b* are arranged at the retract position and the shutter member 130*a* is arranged at the un-covering position. The recording media are sequentially transported by the exit roll 123 toward the compile stacking portion 124, and the recording media stacked on the compile stacking portion 124 are aligned by the paddles 125 and the tamper (not shown). It should be noted that, since the following eject rolls 128*b* are arranged at the retract position and the shutter member 130*a* is arranged at the un-covering position as described above, the following eject rolls 128*b* and the shutter member 130*a* do not hinder the transportation and alignment of the recording media.

Figure 10B:
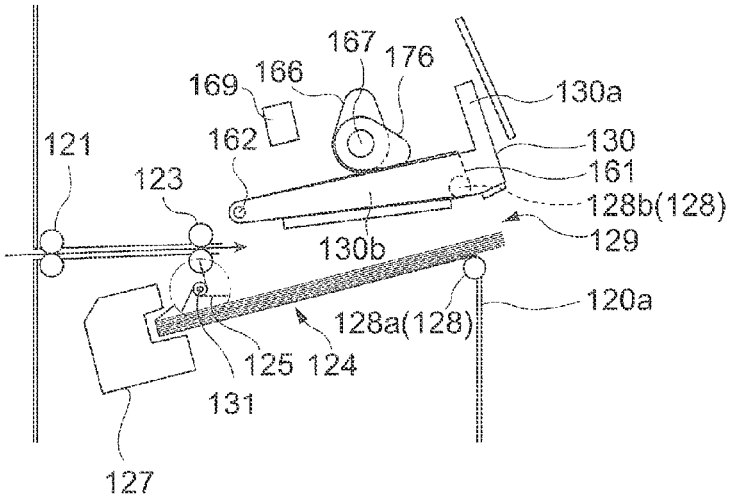

After the aligning process in the compile stacking portion 124 is completed, as shown in FIG. 10B, the controller 200 makes the drive motor 169 drive to rotate the cam shaft 167 in the clockwise direction as viewed in FIG. 10B (step 102). The following eject roll support member 161 is provided with a force to move in the clockwise direction around the support shaft 162 as viewed in FIG. 10B by being pressed by the eject roll cam 166 provided to the rotating cam shaft 167. Accordingly, the following eject rolls 128*b* start to move in the clockwise direction around the support shaft 162. Further, the support members 130*b* are provided with a force to move in the clockwise direction around the support shaft 162 as viewed in FIG. 10B by being pressed by the covering member cams 176 provided to the rotating cam shaft 167. Accordingly, the shutter member 130*a* starts to move in the clockwise direction around the support shaft 162.

Figure 10C:
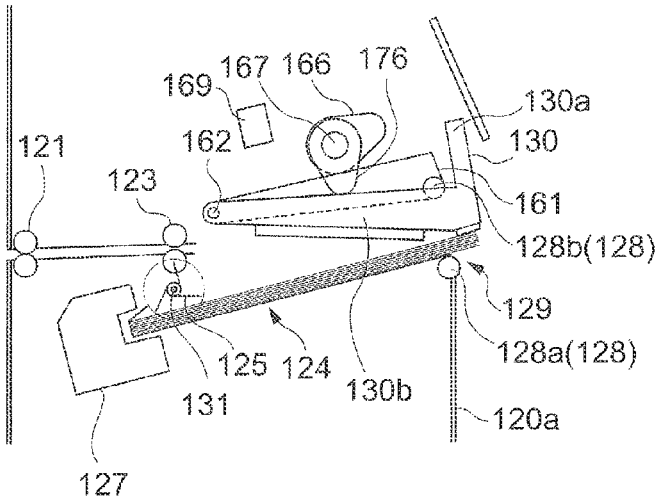

The rotation of the cam shaft 167 by the controller 200 is stopped at an angle where the cam shaft 167 is at the closing angle as shown in FIG. 10C (step 103). In this state, the following eject rolls 128*b* are arranged at the nearby position, and the shutter member 130*a* is arranged at the covering position.

In the state where the following eject rolls 128*b* are arranged at the nearby position and the shutter member 130*a* is arranged at the covering position, the binding process is applied to the recording media stacked on the compile stacking portion 124 by the stapler 127 (step 104).

Here, the state where the shutter member 130*a* is arranged at the covering position means the state where the shutter member 130*a* covers (blocks) the opening portion 129. Since the binding process is performed by the stapler 127 in this state, leakage of the noise generated by the stapler 127 along with the binding process (stapling operation noise) to the outside of the post-processing portion 120 (refer to FIG. 4) through the opening portion 129 is suppressed. In other words, the stapling operation noise is rarely heard around the post-processing portion 120 (refer to FIG. 4).

Further, in the state where the following eject rolls 128*b* are arranged at the nearby position that is separated from the recording media stacked on the recording medium stacking base 124*a* of the compile stacking portion 124 as described above, the binding process is performed by the stapler 127. Since the following eject rolls 128*b* are separated from the recording media, the binding process applied to a stack of recording media stacked on the recording medium stacking base 124*a* in the state of bending (deforming) caused by being caught by the following eject rolls 128*b* and the recording medium stacking base 124*a* is avoided.

After the binding process is applied to the recording media by the stapler 127, the controller 200 makes the drive motor 169 drive to rotate the cam shaft 167 in the clockwise direction as viewed in FIG. 10C again (step 105). The following eject roll support member 161 is provided with the force to move in the clockwise direction around the support shaft 162 as viewed in FIG. 10C by being pressed again by the eject roll cam 166 provided to the rotating cam shaft 167. Accordingly, the following eject rolls 128*b* start to move again in the clockwise direction around the support shaft 162. On the other hand, the support members 130*b* are provided with a force to move in a counterclockwise direction around the support shaft 162 as viewed in FIG. 10C while being pulled by the coil spring 175 (refer to FIG. 4). Accordingly, the shutter member 130*a* starts to move in the counterclockwise direction around the support shaft 162.

Figure 10D:
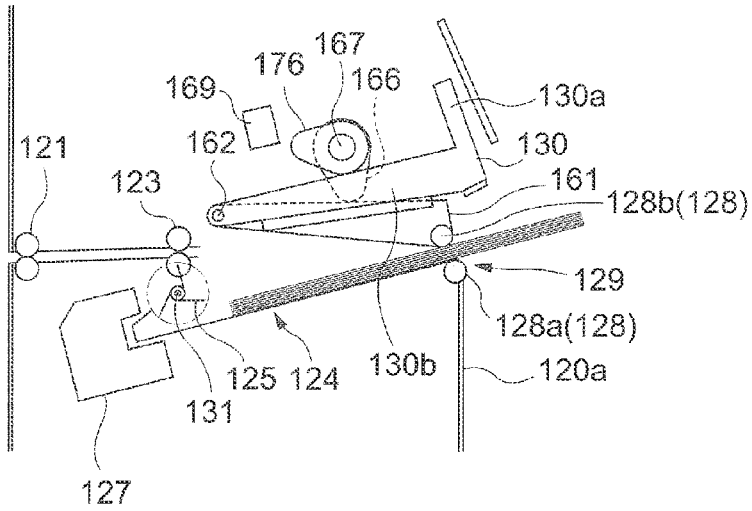

The rotation of the cam shaft 167 by the controller 200 is stopped at an angle where the cam shaft 167 is at the outputting angle as shown in FIG. 10D (step 106). In this state, the following eject rolls 128*b* are arranged at the contact position, and the shutter member 130*a* is arranged at the un-covering position again.

It should be noted that the following eject rolls 128*b* move from the nearby position to the contact position along with the rotation of the cam shaft 167. At this time, compared to the case where the following eject rolls 128*b* move from the retract position to the contact position, which is different from the exemplary embodiment, movement of the following eject rolls 128*b* from the nearby position to the contact position takes a shorter time for moving and results in high productivity.

Then, the controller 200 makes the driving eject motor 128*a* rotate by driving the eject motor (not shown). Accordingly, as shown in FIG. 10E, the recording media are outputted to the stacker 190 (step 107).

It should be noted that since the shutter member 130*a* is arranged at the un-covering position when the recording media are outputted to the stacker 190, the shutter member 130*a* does not contact the recording media and thereby does not hinder the transportation of the recording media.

Figure 10E:
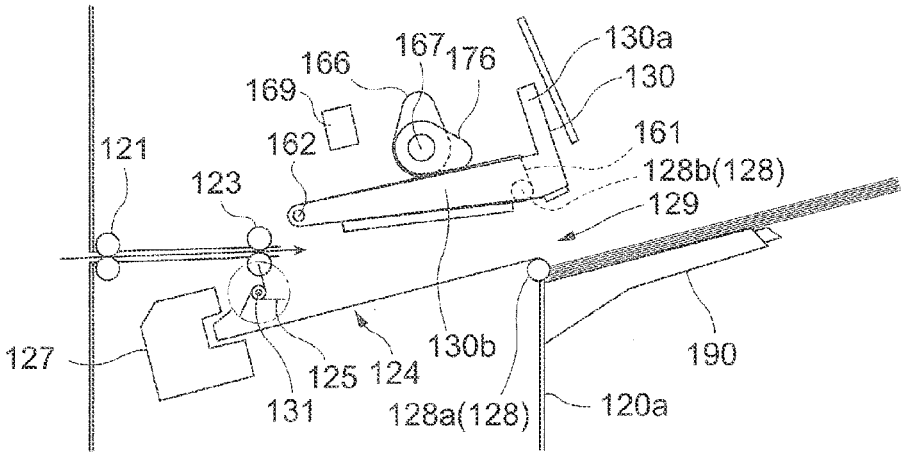

Then, after the recording media are outputted to the stacker 190, the controller 200 makes the drive motor 169 drive to rotate the cam shaft 167 in the clockwise direction as viewed in FIG. 10E, and makes the cam shaft 167 stop at the standby angle (step 108). It should be noted that the cam shaft 167 makes one revolution from the step 101 to step 108, and is arranged at the standby angle again.

Since the cam shaft 167 is arranged at the standby angle again, the following eject rolls 128*b* move in the counterclockwise direction around the support shaft 162 as viewed in FIG. 10E while being pulled by the coil spring 165, and is arranged at the standby position. On the other hand, the shutter member 130*a* maintains the state of being arranged at the un-covering position.

<Other Configuration Example>

In the above-described configuration, description has been given to the operation of the controller 200 for rotating the cam shaft 167 as well as stopping the cam shaft 167 at each of the standby angle, the closing angle and the outputting angle. Here, in the exemplary embodiment, as long as the configuration is such that the following eject rolls 128*b* are arranged at the nearby position and the covering member 130 is arranged at the covering position when the binding process is performed by the stapler 127, and the following eject rolls 128*b* are arranged at the contact position and the covering member 130 is arranged at the un-covering position when the eject roll 128 outputs the stack of recording media, it may be unnecessary to stop the rotation of the cam shaft 167.

For example, in the case where the time of performing the binding process by the stapler 127 is not varied by the conditions of the stack of recording media (the type of recording media, the number of recording media or the like), the configuration such that the rotation of the cam shaft 167 is not stopped during the period from the start of rotation of the cam shaft 167 beginning with the state of stopping at the standby angle to the return to the standby angle again after one revolution may be available. In this case, the eject roll cam 166 and the covering member cams 176 are configured as follows.

First, the eject roll cam 166 is formed so that a region thereof brought into contact with the following eject roll support member 161 during the period in which the stapler 127 performs the binding process is located at the midpoint of a portion of the eject roll cam 166 nearest to the rotational center thereof and a portion of the eject roll cam 166 farthest from the rotational center thereof. Further, the eject roll cam 166 is formed so that a region thereof brought into contact with the following eject roll support member 161 during the period in which the eject roll 128 outputs the stack of recording media becomes a portion of the eject roll cam 166 farthest from the rotational center thereof.

On the other hand, the covering member cams 176 are formed so that a region of each of the covering member cams 176 brought into contact with the support member 130*b* during the period in which the stapler 127 performs the binding process becomes a portion of the covering member cam 176 farthest from the rotational center thereof. Further, the covering member cams 176 are formed so that a region of each of the covering member cams 176 brought into contact with the support member 130*b* during the period in which eject roll 128 outputs the stack of recording media becomes a portion of the covering member cam 176 nearest to the rotational center thereof.

By configuring the eject roll cam 166 as described above, even in the case where the eject roll cam 166 does not stop rotating, the following eject rolls 128*b* maintain the nearby position during the period of performing the binding process, and maintains the contact position during the period of outputting the stack of recording media.

On the other hand, by configuring the covering member cams 176 as described above, even in the case where the covering member cams 176 do not stop rotating, the covering member 130 maintains the covering position during the period of performing the binding process, and maintains the un-covering position during the period of outputting the stack of recording media.

In the above-described configuration, it has been described that the eject roll 128 and the covering member 130 are driven by the common driving source; however, the configuration such that each of the eject roll 128 and the covering member 130 has an independent driving source may be possible. For example, a configuration in which the eject roll cam 166 and the covering member cams 176 are provided to different cam shafts may be available. In this case, the configuration includes a first drive motor that rotates a first cam shaft to which the eject roll cam 166 is provided, and a second drive motor that rotates a second cam shaft to which the covering member cams 176 are provided. Operations of these two drive motors are controlled by the controller 200.

According to the control by the controller 200, during the period in which the stapler 127 performs the binding process, the following eject rolls 128*b* are arranged at the nearby position and the covering member 130 is arranged at the covering position. Further, according to the control by the controller 200, during the period of outputting the stack of recording media, the following eject rolls 128*b* are arranged at the contact position and the covering member 130 is arranged at the un-covering position.

In the above-described configuration, it has been described that the following eject rolls 128*b* move from the retract position to the nearby position and the shutter member 130*a* moves from the un-covering position to the covering position along with the rotation of the cam shaft 167 from the standby angle to the closing angle. Here, in the exemplary embodiment, there is no limitation on the time to move the following eject rolls 128*b* and to move the shutter member 130*a* as long as the following eject rolls 128*b* are arranged at the nearby position and the covering member 130 is arranged at the covering position when the binding process is performed by the stapler 127. Specifically, there may be a mode in which the covering member 130 is arranged at the covering position after the following eject rolls 128*b* are arranged at the nearby position, or may be a mode in which the following eject rolls 128*b* are arranged at the nearby position after the covering member 130 is arranged at the covering position.

Further, it has been described that the following eject rolls 128*b* move from the nearby position to the contact position and the shutter member 130*a* moves from the covering position to the un-covering position along with the rotation of the cam shaft 167 from the closing angle to the outputting angle. Here, in the exemplary embodiment, there is no limitation on the time to move the following eject rolls 128*b* and to move the shutter member 130*a* as long as the following eject rolls 128*b* are arranged at the contact position and the covering member 130 is arranged at the un-covering position when the eject roll 128 outputs the stack of recording media. Specifically, there may be a mode in which the covering member 130 is arranged at the un-covering position after the following eject rolls 128*b* are arranged at the contact position, or may be a mode in which the following eject rolls 128*b* are arranged at the contact position after the covering member 130 is arranged at the un-covering position.

In the above-described configuration, it has been described that, as a configuration for pressing the trailing edges of the recording media on the compile stacking portion 124 into the end guide 124*b*, the post-processing portion 120 of the post-processing device 3 includes the paddles 125; however, the configuration is not limited thereto. For example, in addition to the paddles 125, the configuration may have sub-paddles that are rotatably supported above the compile stacking portion 124, the sub-puddles being located farther than the exit roll 123 with reference to the recording medium stacking surface of the recording medium stacking base 124*a* in a direction orthogonal to (intersecting) the recording medium stacking surface. Further, these sub-puddles may be provided to swing around the cam shaft 167.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a casing having an opening;

a processing mechanism that is provided within the casing and performs a process on a recording medium;

an outputting unit comprising a moving member and a contacting member contacting the recording medium, the moving member moving between a contact position to contact the recording medium and a non-contact position not to contact the recording medium, the outputting unit outputs the recording medium via the opening when the moving member is in the contact position; and a covering member that moves between a covering position to cover the opening and an un-covering position to uncover the opening to allow the recording medium to pass through the opening, wherein, when the processing mechanism performs the process on the recording medium, the covering member moves to the covering position, and after the process is performed by the processing mechanism, the covering member moves to the un-covering position while the moving member moves to the contact position.

2. The post-processing device according to claim 1, further comprising a driving unit that moves the moving member between the contact position and the non-contact position, and moves the covering member between the covering position and the un-covering position.

3. The post-processing device according to claim 2, wherein the driving unit comprises:

a rotational shaft that rotates upon receiving a driving force;

a first pressing portion that is provided to the rotational shaft and presses the moving member to move the moving member between the contact position and the non-contact position along with the rotation of the rotational shaft; and a second pressing portion that is provided to the rotational shaft and presses the covering member to move the covering member between the covering position and the un-covering position along with the rotation of the rotational shaft.

4. The post-processing device according to claim 1, wherein the moving member does not contact the recording medium when the processing mechanism performs the process on the recording medium.

5. The post-processing device according to claim 1, wherein the moving member is arranged at a position nearer to the recording medium than the non-contact position when the processing mechanism performs the process on the recording medium.

6. The post-processing device according to claim 4, wherein the moving member is arranged at a position nearer to the recording medium than the non-contact position when the processing mechanism performs the process on the recording medium.

7. The post-processing device according to claim 1, wherein the processing mechanism performs a binding process on the recording medium using a staple.

8. The post-processing device according to claim 1, wherein the contacting member rotates to transport the recording medium when the moving member is in the contact position.

9. The post-processing device according to claim 8, wherein the outputting unit outputs the recording medium by nipping the recording medium between the moving member and the contacting member when the moving member is in the contact position.

10. The post-processing device according to claim 1, wherein the covering member obstructs the recording medium to pass through the opening when the covering member is in the covering position.

11. The post-processing device according to claim 1 further comprising a sound absorbent which absorbs a sound generated by the processing mechanism when the processing mechanism performs the process on the recording medium.

12. An image forming system comprising:

a casing having an opening;

an image forming mechanism that forms an image on a recording medium;

a processing mechanism that is provided within the casing and performs a process on the recording medium on which the image is formed by the image forming mechanism;

an outputting unit comprising a moving member and a contacting member contacting the recording medium, the moving member moving between a contact position to contact the recording medium and a non-contact position not to contact the recording medium, the outputting unit outputs the recording medium via the opening when the moving member is in the contact position; and a covering member that moves between a covering position to cover the opening and an un-covering position to uncover the opening to allow the recording medium to pass through the opening, wherein, when the processing mechanism performs the process on the recording medium, the covering member moves to the covering position, and after the process is performed by the processing mechanism, the covering member moves to the un-covering position while the moving member moves to the contact position.

* * * * *